US005462112A

United States Patent [19]

Johansson

[11] Patent Number: 5,462,112

[45] Date of Patent: Oct. 31, 1995

[54] PLATE HEAT EXCHANGER

[75] Inventor: Clas-Göran Johansson, Löddeköpinge, Sweden

[73] Assignee: Alfa-Laval Food Engineering AB, Lund, Sweden

[21] Appl. No.: 211,284

[22] PCT Filed: Oct. 7, 1992

[86] PCT No.: PCT/SE92/00699

§ 371 Date: Mar. 28, 1994

§ 102(e) Date: Mar. 28, 1994

[87] PCT Pub. No.: WO93/08438

PCT Pub. Date: April 29, 1993

[30] Foreign Application Priority Data

Oct. 25, 1991 [SE] Sweden ..... 9103122

[51] Int. Cl.[6] ..... F28F 3/08

[52] U.S. Cl. ..... 165/167; 165/78

[58] Field of Search ..... 165/76, 78, 166–167

[56] References Cited

U.S. PATENT DOCUMENTS

| | | | |
|---|---|---|---|
| 1,754,857 | 4/1930 | Harrison | 165/167 X |
| 2,300,663 | 11/1942 | Fette | 165/78 X |
| 2,621,028 | 12/1952 | Newhall | 165/78 |
| 2,639,126 | 5/1953 | Newhall | 165/78 |

FOREIGN PATENT DOCUMENTS 842357 6/1952 Germany .

*Primary Examiner*—Leonard R. Leo

[57] ABSTRACT

In a plate heat exchanger, a package of heat transferring plates is kept together between two end plates by means of two or more threaded bolts and nuts in threading engagement therewith. A motor is arranged through an endless drive member, such as a tooth belt or the like, simultaneously to rotate all the bolts or all the nuts. The plate heat exchanger thereby may be rapidly, simply and safely opened and restored for operation in connection with inspection and/or cleaning of the heat transferring plates.

11 Claims, 4 Drawing Sheets

PLATE HEAT EXCHANGER

Figure 1:
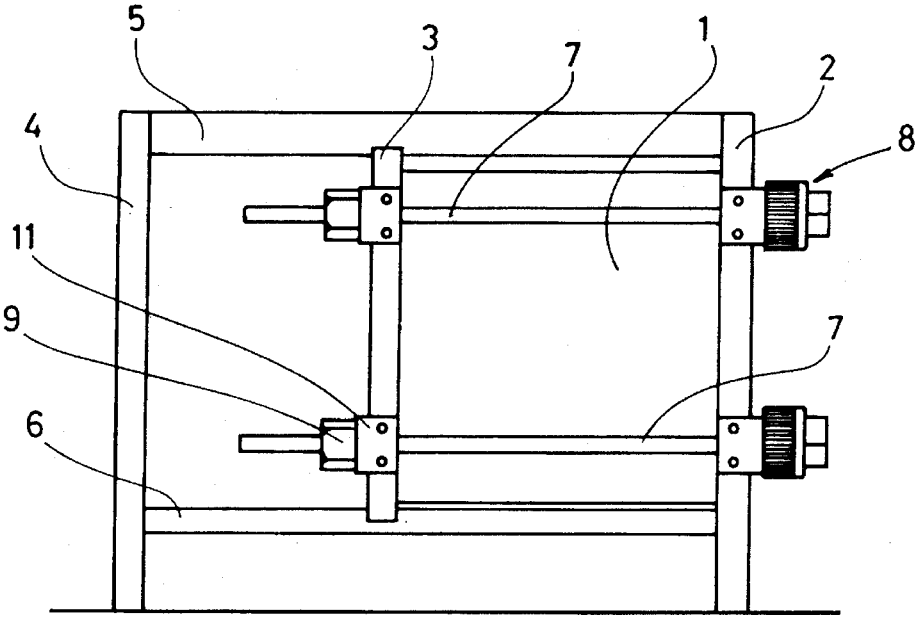

The present invention relates to a plate heat exchanger of the kind comprising a package of heat transferring plates, two end plates between which the package of heat transferring plates are kept together, at least two, preferably at least four, threaded bolts, and nuts or the like in threading engagement each with one of said bolts, the bolts and nuts being arranged for movement of one of said two end plates towards or away from the other end plate.

When used for certain applications a plate heat exchanger of this kind may need to be opended relatively often, e.g. once every day, for inspection and/or cleaning of the heat transferring plates. This means that either the above said bolts or the nuts have to be rotated, so that the end plates and thus the heat transferring plates may be moved away from each other, often as much as 50 centimeters or more.

Such rotation of the bolts or the nuts—in connection with opening of the heat exchanger as well as in connection with restoring of it for operation—means a heavy, time consuming and not quite simple work. It is true, particularly in connection with large plate heat exchangers, that electrically or pneumatically operated tools are used for the rotation, but a tool of this kind has to be moved often between the different bolts or nuts—particularly at the beginning of an opening operation and at the end of a restoring operation—in order that the bolts and end plates will not be subjected to all too uneven loads or stresses. In connection with compression of the package of heat transferring plates it is also important that each one of the bolts or nuts is rotated exactly so much that the end plates in their operating positions will be situated in parallell with each other. If not so, leakage may come up between the heat transferring plates.

The present invention has for its object to provide an apparatus substantially facilitating opening of a plate heat exchanger and restoring of it for operation.

For this purpose it is suggested a plate heat exchanger of the initially defined kind, which is characterized by a flexible endless drive member, such as a tooth belt or the like, which partly surrounds and engages by rotational driving engagement each one of said bolts, or each one of said nuts, and a motor in driving engagement with the drive member for simultaneous rotation of all the bolts or nuts.

By means of such a device the plate heat exchanger may be rapidly and simply opened to a desired degree and, with the same rapidity and simplicity, restored for operation after inspection or Cleaning of the heat transferring plates. Only at one place along the package of heat transferring plates the distance between end plates has to be checked in connection with the compression of the package, because during this compression the end plates all the time are kept in parallel with each other. Through the simultaneous rotation of all the bolts or nuts much time can be saved in connection with opening and restoring of the plate heat exchanger. Further, it is made sure thereby that the bolts and the end plates are subjected to a uniform load or stress during the whole compression of the package of heat transferring plates.

In a preferred embodiment of the invention the bolts extend as draw bolts between the end plates, and the bolts have bolt heads which are arranged to bear directly or indirectly against one of the end plates, said nuts being arranged to bear directly or indirectly against the other end plate. In this embodiment the bolt heads as well as the nuts are preferably coupled to the respective end plates in a way such that they are prevented from moving axially away therefrom during operation of the drive member. Hereby, the end plates in connection with opening of the plate heat exchanger may be moved away from each other to a desired degree, while they are kept parallel with each other, just by driving of the drive member by means of the said motor.

In another embodiment of the invention the bolts are placed between a part of the heat exchanger frame and an end plate movable relative to this frame part, so that the bolts are subjected to axial pressure forces when pressing the movable end plate towards the other end plate.

Preferably, a gear mechanism is inserted between the motor and the drive member, so that the motor does not have to exert a too large torque through its driving shaft. Either the motor is arranged to drive the drive member directly through such a gear mechanism, or the motor is arranged to rotate, through the gear mechanism, one of the bolts or one of the nuts, which is in rotational driving engagement with the drive member.

One or more guide rollers may be arranged for the drive member, so that the latter is caused to surround a larger part than 90° of the circumference of each bolt head or nut.

Figure 2:
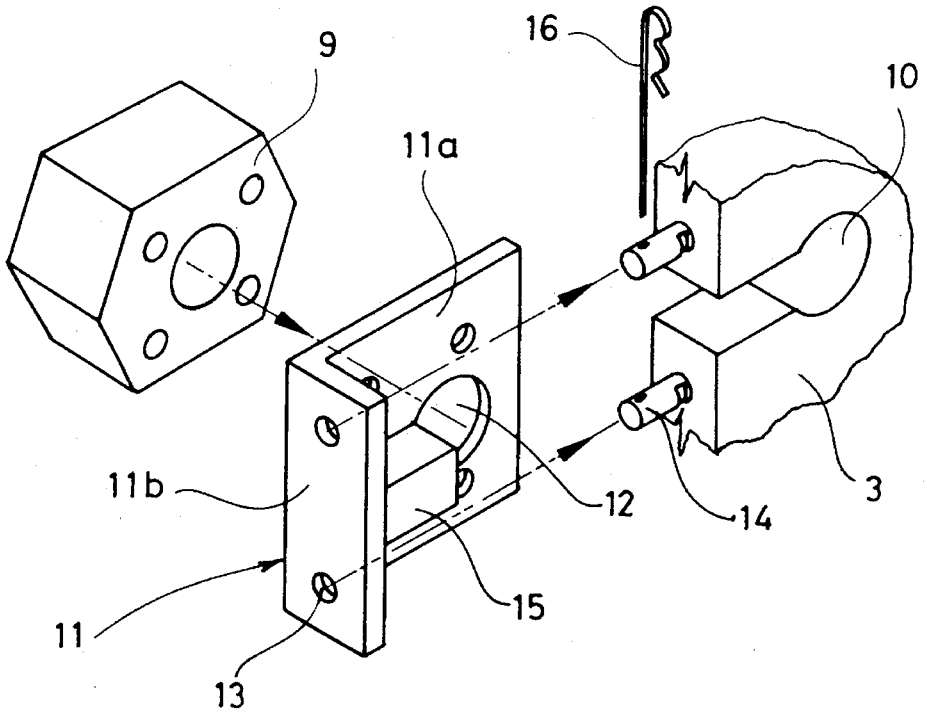
Figure 3:
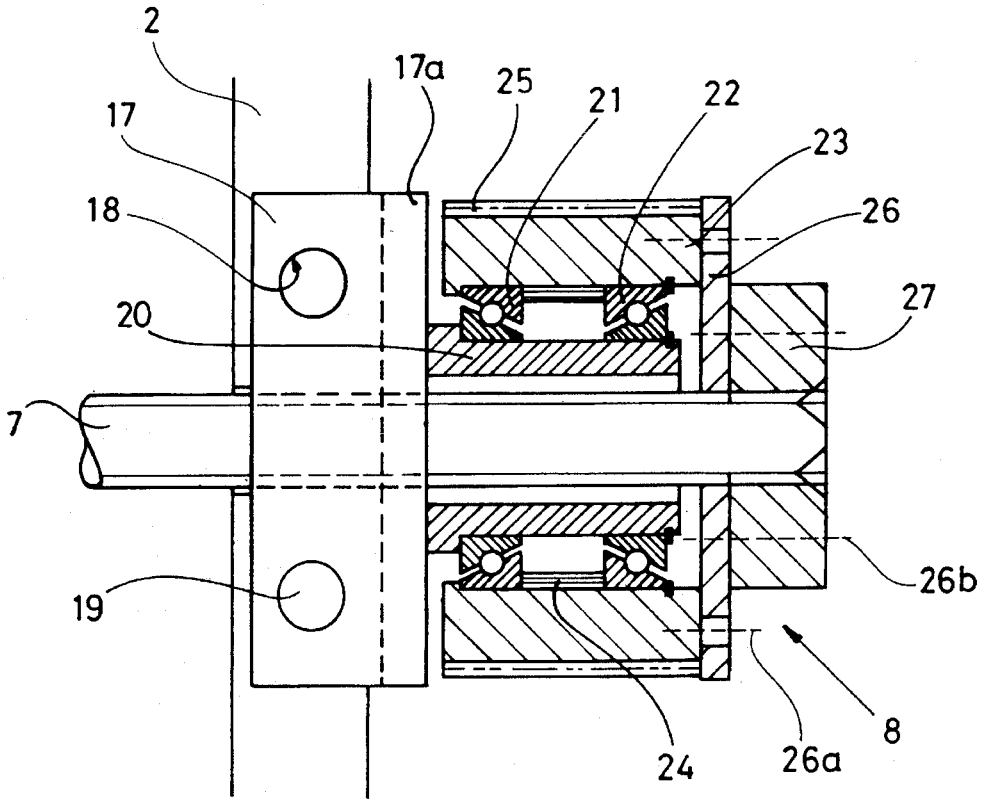
Figure 4:
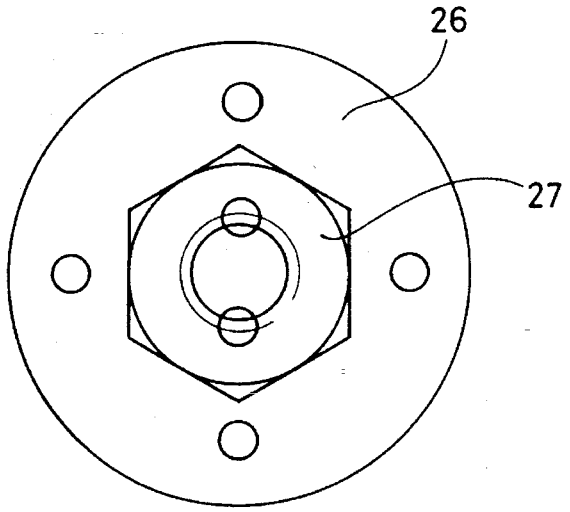
Figure 5:
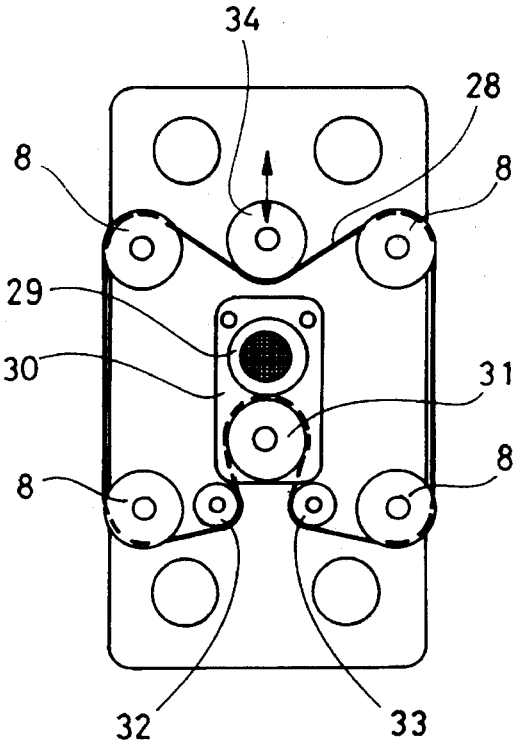
Figure 6:
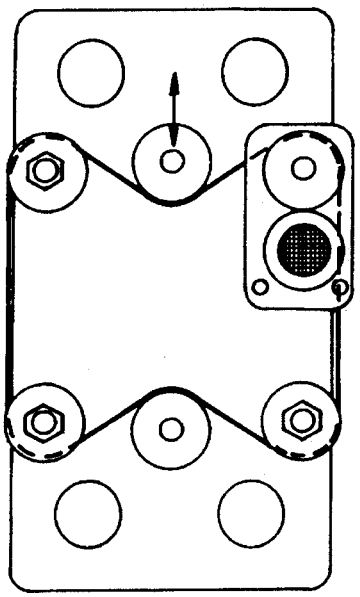
Figure 7:
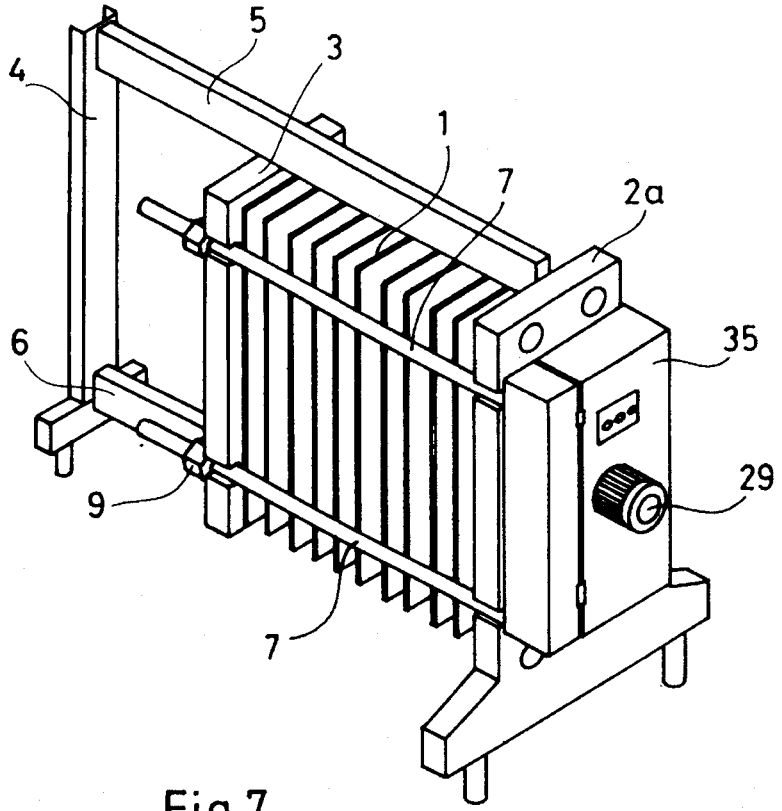
Figure 8:
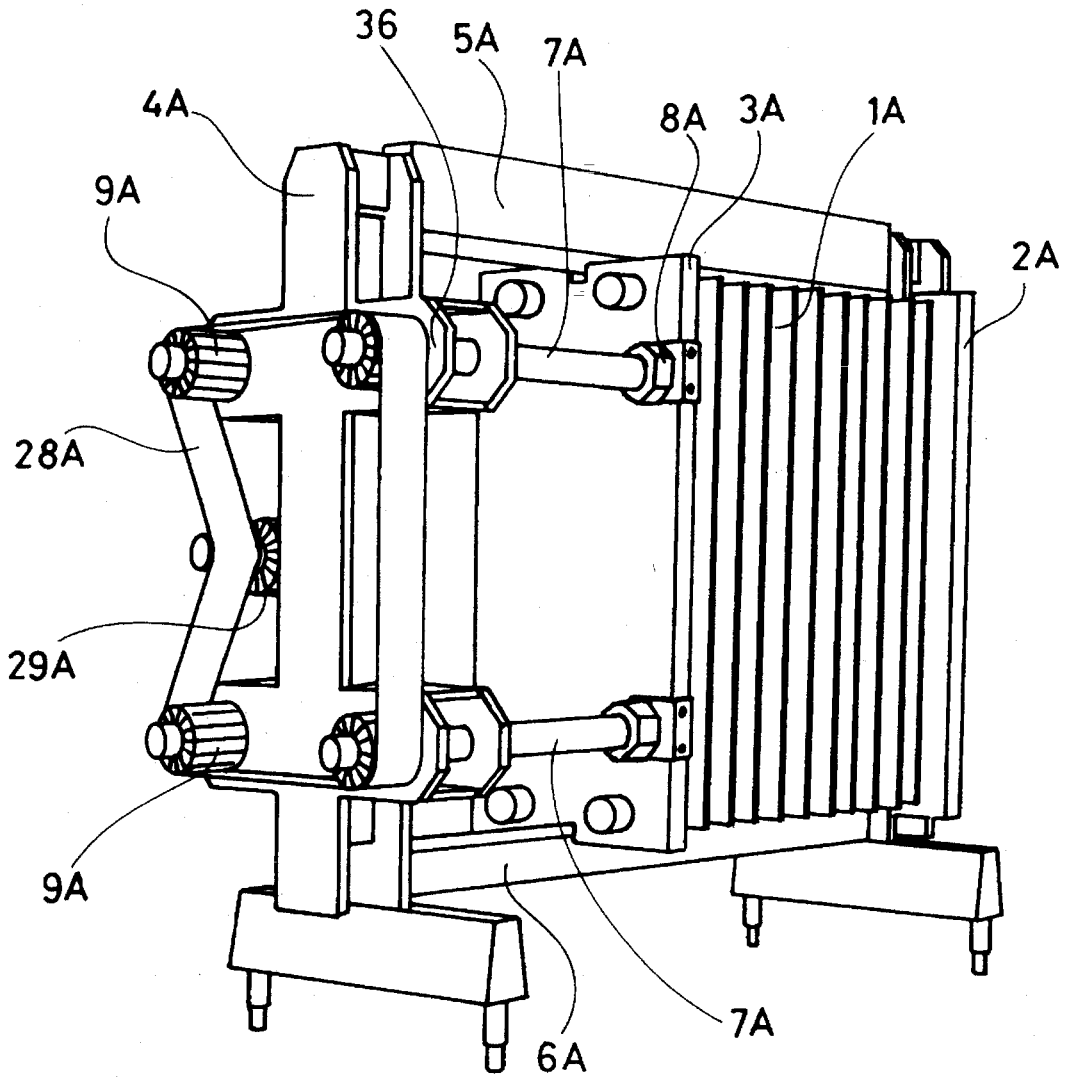

The invention is described more in detail in the following with reference to the accompanying drawing, in which FIG. 1 schematically shows a plate heat exchanger seen from the side, FIG. 2–4 show details of the heat exchanger according to FIG. 1, FIG. 5 shows the plate heat exchanger in FIG. 1 seen from the front, i.e. from the right in FIG. 1, FIG. 6 shows an alternative embodiment of a part of the plate heat exchanger according to the invention, FIG. 7 shows schematically and in perspective a plate heat exchanger according to the invention which is opened for inspection, and FIG. 8 shows an alternative embodiment of a plate heat exchanger according to the invention.

FIG. 1 shows a plate heat exchanger comprising a package of heat transferring plates 1, which are kept together between two end plates 2 and 3. The end plate 2 in the following is called the frame plate, and the end plate 3 is called the pressure plate. The frame plate 2 is part of a frame which for the rest comprises a support column 4 and an upper horizontal beam 4 and a lower horizontal beam 6. The beams 5 and 6 are firmly connected with the frame plate 2 and the support column 4 and support between themselves the package of heat transferring plates 1 and the pressure plate 3.

The heat transferring plates 1, which between themselves usually have flexible edge gaskets and some further gaskets (not shown) for defining flow spaces between the plates for two heat exchange fluids, are kept together in this case by four at least partly threaded bolts 7. The bolts 7 extend between the frame plate 2 and the pressure plate 3 and through recesses in the edge portions of these plates. Each bolt 7 has a bolt head means 8 (schematically shown) at one of its ends, situated at the outside of the frame plate 2, and carries a nut 9 on its threaded part, situated at the outside of the pressure plate 3.

FIG. 2 shows a part of the edge portion of the pressure plate 3, which edge portion has a recess 10 that opens towards one side. As can be seen, the recess 10 has a substantially cylindrical inner part extending across and through the pressure plate 3 at some distance from its edge, and an outer part situated between the cylindrical part and the edge of the pressure plate. Said outer part has a width, i.e. a vertical extension, that is somewhat smaller than the diameter of the cylindrical inner part.

A threaded bolt 7 may be inserted into the recess 10 from the side, i.e. from the edge of the pressure plate 3, and then rest in the cylindrical inner part of the recess 10 without rolling out by itself.

FIG. 2 further shows a nut 9 and a plate formed coupling member 11 that is bent to form an angle of 90°. The coupling member 11 has a first portion 11*a*, which has a through hole 12 and which is intended to be firmly connected, with the nut 9 by means of for instance four screws, so that the hole 12 and the hole of the nut will be situated opposite to each other. Another portion 11*b* of the coupling member 11 has two smaller through holes 13, through which two pins 14 protruding from the edge of the pressure plate 3 on respective sides of the recess 10 are supposed to extend.

The coupling member 11 further has a protrusion 15 arranged to suit into the outer part of the recess 10, when the coupling member 11 is connected with the pressure plate 3. The coupling member 11 is intended to be kept in place at the pressure plate 3 by means of a locking peg 16 arranged outside the coupling member portion 11*b* to extend through holes in the pins 14.

When a nut 9 with its coupling member 11 has been threaded onto a bolt 7, the bolt may be inserted into the recess 10 of the pressure plate so that the pins 14 will extend through the holes 13. The nut 9 then indirectly, i.e. through the coupling member 11, will bear against the outside of the pressure plate 3 and be connected with the pressure plate 3 in a way such that it may not rotate or move axially relative thereto.

FIG. 3 shows a part of the frame plate 2 and a portion of a bolt 7. Further, it shows in detail and in longitudinal section the bolt head means 8 which is only schematically shown in FIG. 1.

Like the pressure plate 3 the frame plate 2 for each bolt 7 has a recess of the same kind as the recess 10 in FIG. 2. Further, for each bolt 7 there is a plate formed coupling member 17 bent to form an angle of 90° and having two holes 18 for two pins 19 protruding from the edge of the frame plate 2.

Onto a portion 17*a* of the coupling member 17, parallel with the frame plate 2, there is welded a sleeve 20 which surrounds the bolt 7 with some clearance. The inner bearing rings of two angular contact bearings 21 and 22 are connected with and surrounds the sleeve 20, whereas the outer bearing rings of the same bearings are connected with a cog-wheel 23 surrounding themselves. The bearing 21 abuts axially in one direction against shoulders on the sleeve 20 and the cog-wheel 23, respectively, whereas the bearing 22 abuts axially in the other direction against two locking rings which are connected with the sleeve 20 and the cog-wheel 23, respectively. A spacing sleeve 24 keeps the bearings 21 and 22 at a distance from each other.

The cog-wheel 23 has on its circumferential surface cogs 25 and carries at its part turned away from the frame plate 2 an annular plate 26 which is coaxial with the bolt 7. As is indicated in FIG. 3, the plate 26 by means of screws or the like, indicated by dotted lines 26*a* through holes in the plate 26, is connected to the cog-wheel 23. Further, the plate 26, as indicated by dotted lines 26*b* in FIG. 3, is firmly connected with a hexagonal bolt head 27, which in turn is firmly connected with the end portion of the bolt 7.

FIG. 4 shows the whole bolt head means 8 seen from the right in FIG. 3.

Upon rotation of a bolt head 27 by means of a tool the bolt 7 will be rotated and the nut 9 (FIG. 1) will move axially along the bolt 7. Owing to the fact that the nut 9 is connected with the pressure plate 3 by means of the coupling member 11 in the manner described with reference to FIG. 1 and 2 the pressure plate 3 will be carried by the nut 9 along the bolt 7. The axial forces then influencing the bolt 7 will be taken up by the frame plate 2 through the sleeve 20 by the fact that the bearings 21 and 22 are axially fixed relative to the sleeve 20 and the cog-wheel 23, as described previously.

FIG. 5 shows the frame plate 2 seen from the right in FIG. 1. Four bolt head means 8 are shown placed in the corners of an imaginary rectangle. Around all of the bolt head means 8 there extends a flexible tooth belt 28, which is in rotational drive engagement with the respective cog-wheels 23 (FIG. 3) along part of the circumference of each cog-wheel.

On the frame plate 2 there is mounted an electrical motor 29 which through a gear mechanism housed within a casing 30 is drivingly connected with a driving wheel 31. On the frame plate 2 there are also rotatably mounted three guide rollers 32, 33 and 34 for the tooth belt 28.

The tooth belt 28, which may have teeth on both of its sides, extends in the way that can be seen from FIG. 5, the location of the guide rollers 32 and 33 giving as a result that the tooth belt 28 surrounds the larger part of the driving wheel 31, and the location of the guide roller 34 giving as a result that the tooth belt 28 surrounds somewhat more than one fourth (90°) of the two upper bolt head means 8. As illustrated by means of arrows in FIG. 5, the guide roller 34 is adjustable into different positions, so that the tension in the tooth belt 28 can be adjusted when needed.

Upon starting of the motor 29 for operation of the tooth belt 28 clock-wise with respect to FIG. 5, all of the bolts 7 of the plate heat exchanger (FIG. 1) will be rotated in one and the same direction, the nuts 9 and the pressure plate 3 moving towards the frame plate 2 and compressing the package of heat transferring plates 1. Upon simultaneous rotation of the bolts 7 in the opposite direction, the nuts 9 and the pressure plate 3 will, instead, move away from the frame plate 2.

By the simultaneous and uniform rotation of all the bolts 7, and by the fact that the nuts 9 are connected with the pressure plate 3 and the bolt head means 8 are connected with the frame plate 2 in the above described manner the pressure plate 3 during all of its movement will be maintained in a position in which it is situated in parallel with the frame plate 2. The package of heat transferring plates will thus be compressed and opened to the same degree along all of its circumference.

It has been described above that the motor 29 and the tooth belt 28 are provided at the frame plate 2 for rotation of the bolts 7. Alternatively, the motor 29 and the tooth belt 28 may be arranged at the pressure plate 3 and arranged for rotation of the nuts 9. In this case, the nuts 9 would of course be rotatable relative to the pressure plate 3, whereas instead the bolt heads 27 would be connected with the frame plate 2 in a manner such that they could not rotate relative thereto. For the rest, like in the above described embodiment of the invention, the nuts 9 as well as the bolt heads 27 would have been connected with the respective end plates in a manner such that they would not be able to move axially relative to these respective end plates.

The above described connection of the bolt heads and the nuts with the respective end plates may be accomplished in many different ways within the scope of the present invention.

Also, the driving of the tooth belt may be accomplished in many different ways within the scope of the invention. For instance, the tooth belt may be driven by means of a motor the driving shaft of which is coupled through a gear mechanism to one of the relevant bolt heads or one of the relevant nuts of the heat exchanger. An arrangement of this kind is schematically illustrated in FIG. 6 which shows a frame plate on which a motor is mounted at one of the frame plate corners.

FIG. 7 shows schematically a plate heat exchanger according to the invention opened for inspection or cleaning of the heat transferring plates. The device for driving of the tooth belt is mounted on the frame plate 2*a* but is covered by a casing 35. In this case the coupling members for axial fixation of the bolt heads relative to the frame plate 2 have been designed in a different manner (not shown) than that to be seen from FIG. 3, and the nuts 9 are simply welded onto or connected in some other way directly to the pressure plate 3.

It has been described above that a motor may be mounted on one of the end plates and that a tooth belt may be mounted such that it is in rotational driving engagement with the bolt heads or nuts situated at this end plate. Within the scope of the invention there is also a possibility that the motor as well as the tooth belt may be mounted on a separate carrier, which in turn in one way or another is carried by the plate heat exchanger. For instance, a carrier of this kind may be suspended from and be movable along the upper horizontal beam 5 (FIG. 1). In a case like this the tooth belt may extend around and be in rotational driving engagement with a number of rotatable sleeves, which are arranged and designed such that upon movement of the carrier along the beam 5 they may be brought into engagement each with one of the nuts 9. A unit designed in this manner may be situated close to the supporting column 4 when not in use.

Instead of a tooth belt any kind of endless drive member, such as a drive chain or the like, may of course be used.

FIG. 8 shows a plate heat exchanger according to an alternative embodiment of the invention. Parts of this plate heat exchanger which correspond to parts of the heat exchanger according to FIG. 1–7 have the same reference numerals but with the additon of the letter A.

As can be seen from FIG. 8 the bolts 7A extend from the bolt head means 8A, arranged at the pressure plate to and through holes in extensions 36 of the support column 4A. Each of the bolt head means 8A is fixed to the pressure plate 3A, so that the bolts 7A can not rotate or move axially relative to the pressure plate 3A.

At the extension 36 of the support column 4A the nuts 9A are in threading engagement with the end portions of the bolts 7A. The nuts 9A are rotatable but axially fixed relative to the extensions 36. Hereby, upon operation of the tooth belt 28A by means of the motor 29A, i.e. upon rotation of the nuts 9A, the bolts 7A will be moved axially so that the pressure plate 3A moves towards or away from the support column 4A. In other words, by means of the motor 29A the pressure plate 3A may be caused to compress the package of heat transferring plates 1A against the frame plate 2A or to open the plate package for inspection and/or cleaning of the heat transferring plates.

I claim:

1. A plate heat exchanger comprising a package of heat transferring plates (1), two end plates (2, 3) between which the package of heat transferring plates (1) is kept together, at least two threaded bolts (7), said bolts extending between the end plates (2, 3) and having bolt heads (27) arranged to bear directly or indirectly against one (2) of the end plates, a plurality of nuts (9), each in threaded engagement with one of said bolts (7) and arranged to bear directly or indirectly against the other end plate (3), the bolts (7) and nuts (9) being arranged for movement of one of said two end plates toward or away from the other, said heat exchanger further comprising a flexible endless drive member (28) partly surrounding and engaging by rotational driving engagement each of said bolts (7) or each of said nuts (9), and a motor (29) in driving engagement with the drive member (28) for simultaneous rotation of all the bolts (7) or nuts (9), said bolt heads (27) and said nuts (9) being coupled to their respective end plates (2, 3) in a manner such that they are prevented from moving axially away from their respective end plates (2, 3) upon operation of the drive member (28).

2. A plate heat exchanger according to claim 1, in which each bolt head (27), or nut (9), which is not in engagement with the drive member (28), is coupled to its end plate in a manner such that it is prevented from rotating upon operation of the drive member (28).

3. A plate heat exchanger according to claim 1, in which a friction reducing bearing (21,22) is arranged between each bolt head (27), or nut (9), which is in driving engagement with the drive member (28), and the relevant end plate.

4. A plate heat exchanger according to claim 1, in which said motor (29) is arranged to drive the drive member (28) through one of the bolts (7) or one of the nuts (9).

5. A plate heat exchanger according to claim 1, in which a gear mechanism (30) is coupled between the motor (29) and the driving member (28).

6. A plate heat exchanger according to claim 1, in which the drive member (28) extends around parts of at least four bolts (7), or nuts (9), situated in the corners of an imaginary rectangle, at least one guide roller (24) is arranged for the drive member (28), and the drive member (28) extends around part of the guide roller (24) in a way such that it is in driving engagement with at least two bolts (7), or nuts (9), along more than one fourth (90°) of their respective circumferences.

7. A plate heat exchanger according to claim 1, in which the motor (29) and the drive member (28) are mounted on the plate heat exchanger.

8. A plate heat exchanger comprising a package of heat transferring plates (1), two end plates (2, 3) between which the package of heat transferring plates (1) is kept together, at least two threaded bolts (7), said bolts extending between the end plates (2, 3) and having bolt heads (27) arranged to bear directly or indirectly against one (2) of the end plates, a plurality of nuts (9), each in threaded engagement with one of said bolts and arranged to bear directly or indirectly against the other end plate (3), the bolts (7) and nuts (9) being arranged for movement of one of said two end plates toward or away from the other, said heat exchanger further comprising a flexible endless drive member (28) partly surrounding and engaging by rotational driving engagement each of said bolts (7) or each of said nuts (9), a motor (29) in driving engagement with the drive member (28) for simultaneous rotation of all the bolts (7) or nuts (9), and a friction reducing bearing (21, 22) arranged between each bolt head (27), or nut (9), which is in driving engagement with the drive member (28), and the relevant end plate.

9. A plate heat exchanger comprising a package of heat transferring plates (1), two end plates (2, 3) between which the package of heat transferring plates (1) is kept together, at least two threaded bolts (7)

a plurality of nuts (9) each in threaded engagement with one of said bolts, the bolts (7) and nuts (9) being arranged for movement of one of said two end plates toward or away from the other, said heat exchanger further comprising a flexible endless drive member (28) which partly surrounds and engages by rotational driving engagement each of said bolts (7) or each of said nuts (9), and a motor (29) arranged to drive said drive member (28) through one of said bolts (7) or one of said nuts (9) for simultaneous rotation of all of said bolts (7) or nuts (9).

10. A plate heat exchanger comprising a package of heat transferring plates (1A), two end plates (2A, 3A) between which the package of heat transferring plates (1A) is kept together, at least two threaded bolts (7A)

a plurality of nuts (9A) each in threaded engagement with one of said bolts, the bolts (7A) and nuts (9A) being arranged for movement of one of said two end plates toward or away from the other, said heat exchanger further comprising a flexible endless drive member (28A) which partly surrounds and engages by rotational driving engagement each of said bolts (7A) or each of said nuts (9A), a motor (29A) in driving engagement with the drive member (28A) for simultaneous rotation of all the bolts (7A) or nuts (9A), and a frame (4A–6A) for carrying the heat transferring plates (1A) and the end plates (2A–3A), one (2A) of the end plates being fixed and the other (3A) being movable with relation to said frame, said bolts (7A) being arranged between the frame (4A–6A) and the movable end plate (3A) and arranged to press said movable end plate (3A) towards the other end plate (2A) and thereby to be subjected to axial pressure forces.

11. A plate heat exchanger comprising a package of heat transferring plates (1), two end plates (2, 3) between which the package of heat transferring plates (1) is kept together, at least two threaded bolts (7), a plurality of nuts (9) each in threaded engagement with one of said bolts, the bolts (7) and nuts (9) being arranged for movement of one of said two end plates toward or away from the other, said heat exchanger further comprising a flexible endless drive member (28) which partly surrounds and engages by rotational driving engagement each of said bolts (7) or each of said nuts (9), a motor (29) in driving engagement with the drive member (28) for simultaneous rotation of all the bolts (7) or nuts (9), and at least one guide roller for the drive member, said drive member extending around parts of at least four bolts (7) or nuts (9) situated in the corners of an imaginary rectangle, and around part of the guide roller (24) in such a way that it is in driving engagement with at least two bolts (7) or nuts (9) along more than one fourth (90°) of their circumference.

* * * * *

UNITED STATES PATENT AND TRADEMARK OFFICE

CERTIFICATE OF CORRECTION

PATENT NO. : 5,462,112

DATED : October 31, 1995

INVENTOR(S) : Clas-Goran Johansson

It is certified that error appears in the above-indentified patent and that said Letters Patent is hereby corrected as shown below:

Col. 5, line 38, after "plate", insert --3A--.

Signed and Sealed this

Twenty-third Day of July, 1996

*Attest:*

Bruce Lehman

BRUCE LEHMAN

*Attesting Officer*

*Commissioner of Patents and Trademarks*